US005752610A

United States Patent [19]

Remmers

[11] Patent Number: 5,752,610

[45] Date of Patent: May 19, 1998

[54] FREE STANDING ADJUSTABLE STORAGE SYSTEM

[75] Inventor: Lee Remmers, Ocala, Fla.

[73] Assignee: Clairson, Inc., Newark, Del.

[21] Appl. No.: 675,652

[22] Filed: Jul. 3, 1996

[51] Int. Cl.[6] ..... A47F 5/00

[52] U.S. Cl. ..... 211/181.1; 211/186; 211/188; 108/181

[58] Field of Search ..... 211/181.1, 186, 211/187, 188, 106, 59.2, 182, 133.5; 108/181, 154, 192, 193, 92; 248/243, 218.4, 418, 250; D6/407, 462, 463, 464, 465, 474, 477, 479; 312/3, 5, 6, 265.1, 257.1

[56] References Cited

U.S. PATENT DOCUMENTS

| | | | |
|---|---|---|---|
| 2,553,960 | 5/1951 | De Swart | 248/250 |
| 3,784,026 | 1/1974 | Grosse . | |
| 3,861,327 | 1/1975 | Silson | 108/91 |
| 4,007,841 | 2/1977 | Seipel | 211/59.1 |
| 4,099,472 | 7/1978 | Kellogg | 108/114 |
| 4,558,647 | 12/1985 | Petersen | 108/107 |
| 4,928,833 | 5/1990 | Huizenga . | |
| 5,027,959 | 7/1991 | Luukkonen . | |
| 5,167,331 | 12/1992 | Luukkonen | 211/186 |
| 5,240,127 | 8/1993 | Levin et al. | 211/186 |
| 5,326,062 | 7/1994 | Remmers | 248/250 |
| 5,622,415 | 4/1997 | Felsenthal et al. | 211/181.1 |

*Primary Examiner*—Robert W. Gibson, Jr.
*Attorney, Agent, or Firm*—Middleton & Reutlinger; Charles G. Lamb

[57] ABSTRACT

A free standing adjustable storage system includes a pair of support feet in spaced parallel alignment with a pair of vertical support members mounted onto the support feet with a horizontally extending wire shelf being sandwiched therebetween. The support feet are provided with grooves and slots therein to receive vertically spaced front edge wires of the wire shelf and a cavity is provided to receive a downwardly extending leg of the vertically extending support members.

7 Claims, 4 Drawing Sheets

FREE STANDING ADJUSTABLE STORAGE SYSTEM

BACKGROUND OF THE INVENTION

This invention relates to free standing storage systems and more particularly to a free standing adjustable storage system with shelves, clothes hanger rods, and the like.

Metal shelving utilizing wires or rods in combination with upright support members are used in a variety of applications in commercial use as well as in homes to provide inexpensive, light in weight, and strong shelving. The shelf support for the metal shelves are often disposed within frame support members and are generally welded to the support frame or held to the frame by unsightly screws, brackets and the like. The support rods enclosed within the frame members which are welded to the frames present additional problems, particularly in the assembly and disassembly of the shelving for adjusting of the shelves heights or in the removal of the shelves. In this case, considerable time is utilized in assembling and disassembling. Thus, most of the existing shelf brackets use screws or projections extending from the brackets for support to the frame to support shelves and such screws and projections are unsightly in appearance.

SUMMARY OF THE INVENTION

Accordingly, it is a principal object of the present invention to provide a free standing adjustable storage system.

It is another object of the present invention to provide an adjustable storage system for any size space.

It is even another object of the present invention to provide an adjustable storage system which incorporates shelving, hanger bars and other accessory items for storage.

It is an even further object of the present invention to provide a storage system having components which snap together for easy assembly and adjustment without the use of screws or other unsightly projections used in constructing storage systems.

It is an even further object of the present invention to provide a standable, adjustable storage system wherein no hardware or tools are required to assembly or disassemble the system.

Also, an object of the present invention is to provide an adjustable storage system which is light in weight for easy transportation.

It is an even further object of the present invention to provide an adjustable storage system which is strong and holds weight loads comparable to wall mounted systems.

In the present invention, a free standing adjustable storage system is provided with a support structure assembled by fitting upright components into feet or other upright support members. Shelf and accessory modules lock into a vertical support assembly without hardware or tools. The system is highly adaptable and flexible thereby allowing the user to create a custom storage space in a matter of minutes.

More particularly, the present invention provides a free standing, adjustable storage system comprising: a pair of support feet in spaced parallel alignment, each foot having a top with means to receive a horizontally extending wire shelf and a toe of a vertically extending support leg; and, a wire shelf mounted onto the pair of support feet, each of said support legs being mounted onto each of the support feet with the wire shelf sandwiched therebetween. Wire return strips may also be mounted onto the support feet, the wire return strips being sandwiched between support feet and support legs.

Accordingly, other objects, features and advantages of the present invention will be apparent by reference to the following description of preferred embodiments, drawings, and claims.

BRIEF DESCRIPTION OF THE DRAWINGS

A better understanding of the present invention will be obtained from the following detailed description of the preferred embodiments described in connection with the accompanying drawings wherein.

DETAILED DESCRIPTION OF THE PREFERRED EMBODIMENT

Figure 1:
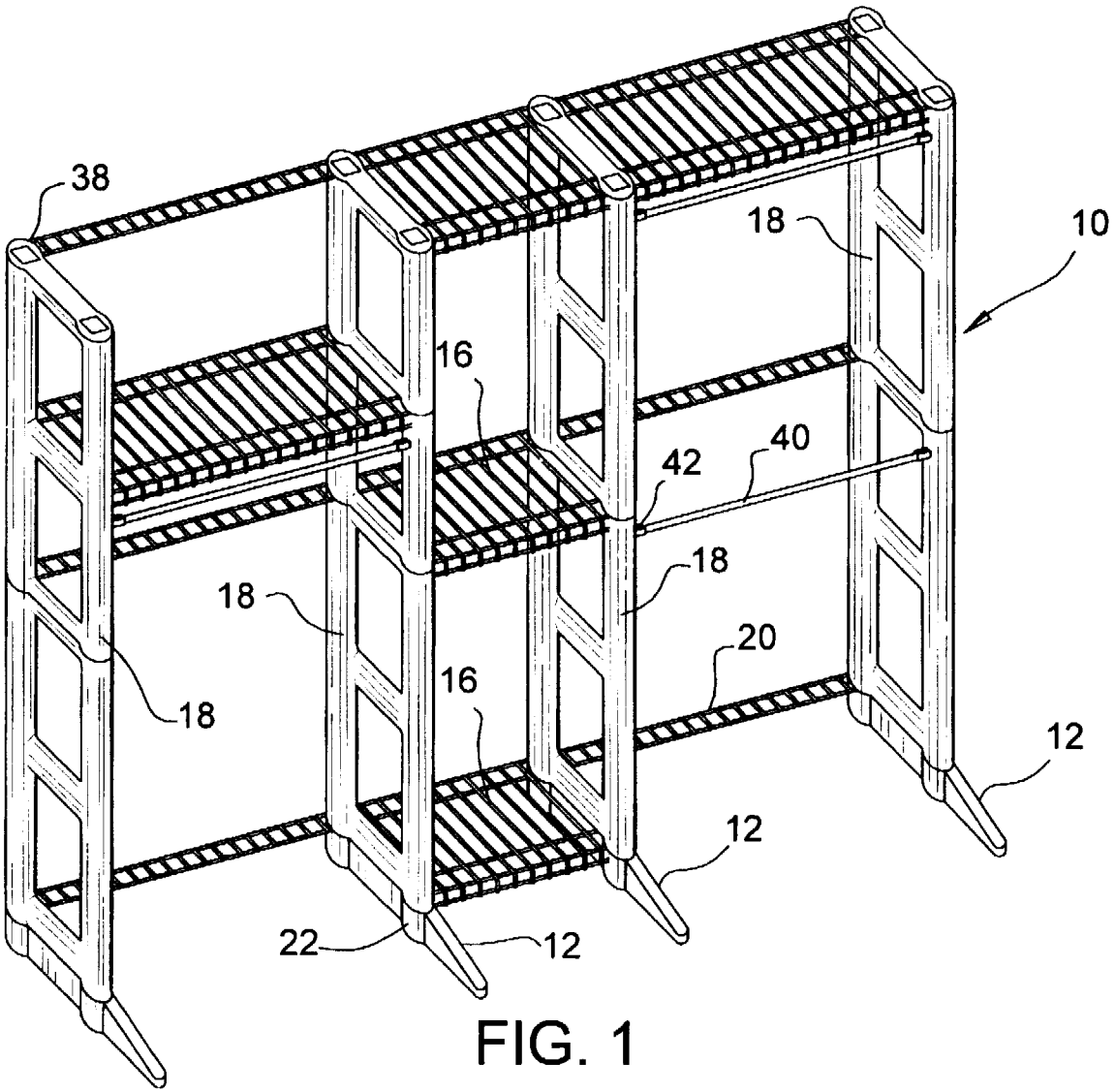
FIG. 1 is a perspective view of one preferred free standing adjustable storage system of the present invention.

In FIG. 1 is shown a free standing adjustable storage system of the present invention as identified by the numeral 10. The free standing adjustable storage system 10 includes a plurality of support feet 12, at least one pair of support feet 12 being necessary for the construction of a free standing adjustable storage system 10. To the support feet 12 is mounted wire shelves 16, wire return strips 20, and vertical support members 18. The free standing adjustable storage 10 may also include numerous accessories for storage, including for example, a closet pole 40 which is mounted to a pair of spaced vertical support members 18 with clips 42 being any known in the art utilized for connecting the closet poles 40 to the vertical support members 18.

Figure 2:
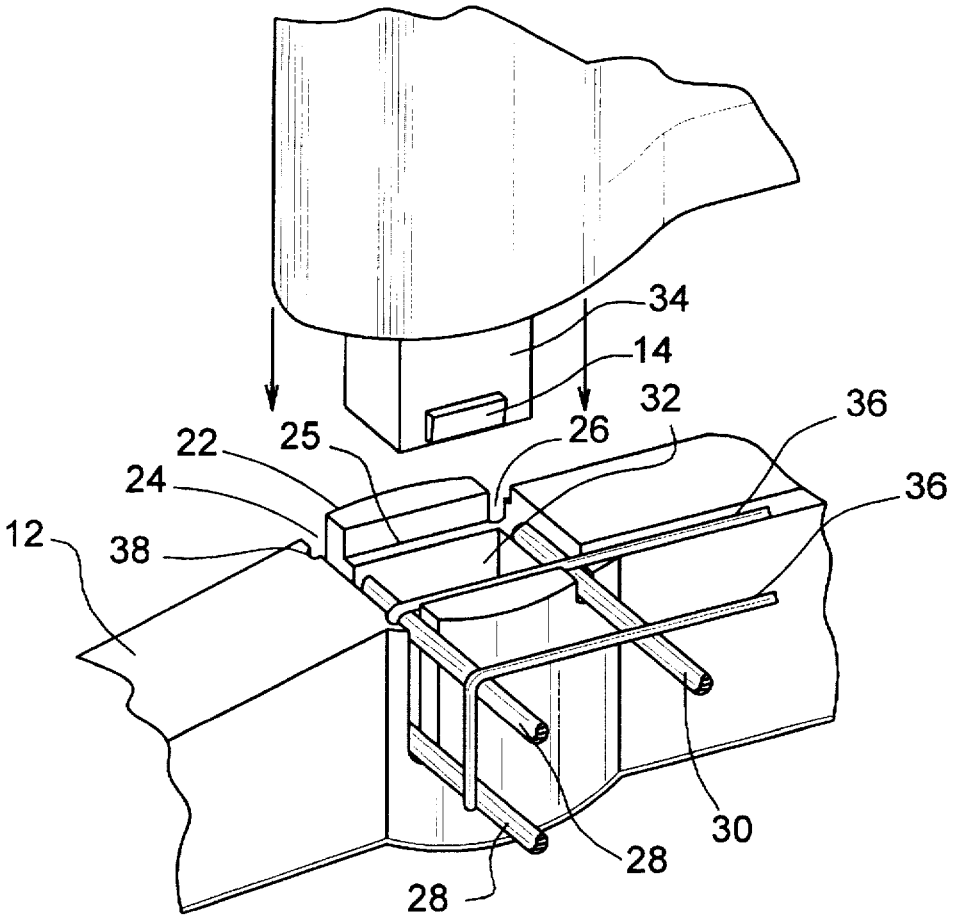
FIG. 2 is an enlarged perspective view of a connecting assembly for the assembling of an adjustable storage system as shown in FIG. 1.
Figure 3:
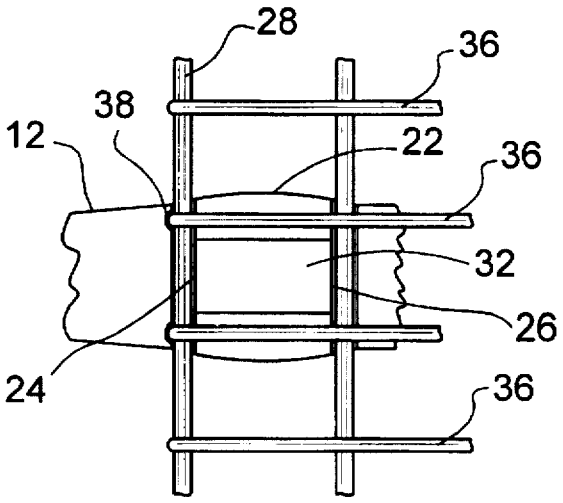
FIG. 3 is a top view of the connection as shown in FIG. 2.
Figure 4:
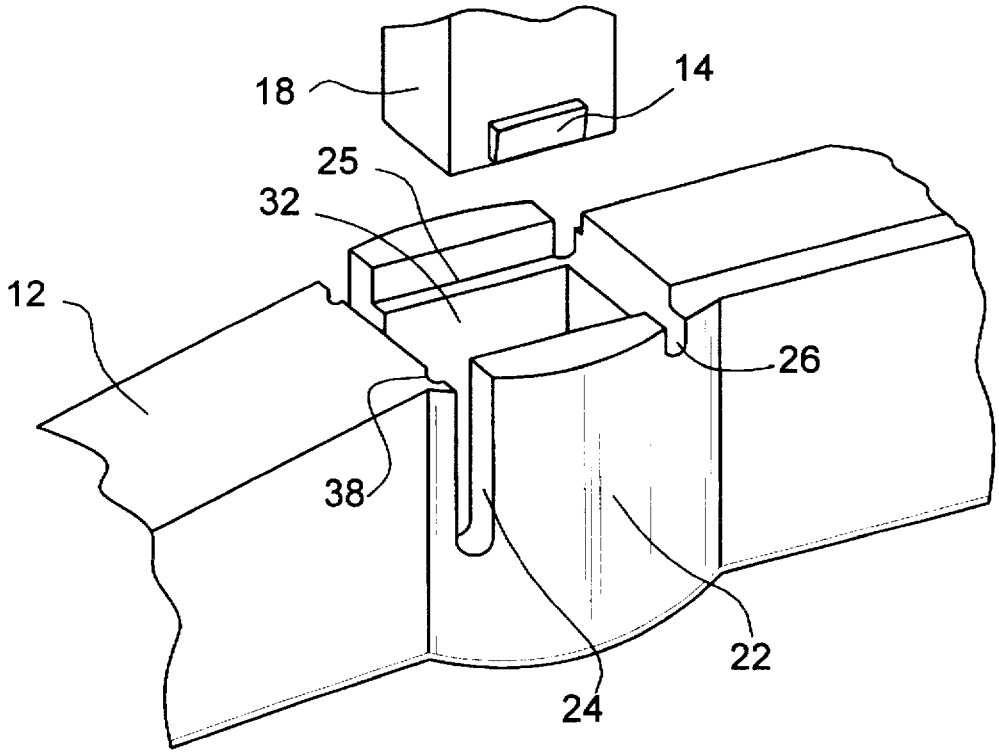
FIG. 4 is an enlarged perspective view of the connecting assembly of claim 1 showing the connecting assembly of a support foot receiving an upright support member.

As shown in FIGS. 2–4, support feet 12 are provided with a heel portion 22 to which the wire shelves 16 and the rectangular shaped vertical or upright support members 18 and the wire return strips 20 are mounted. The heel portion 22 is provided with a vertically extending slot 24 which receives the terminating end of the wire shelf 16 which includes a pair of vertically spaced front horizontally extending longitudinal wires 28. The wire shelf 16 is also provided with a horizontally extending longitudinal intermediate wire 30, wire 30, as shown in FIG. 2, being spaced a preselected distance from the front longitudinally extending wires 28 and received within a second vertically extending slot 26 in the heel portion 22. The spacing between the first vertically extending slot 24 and the second vertically extending slot 26 is the same spacing distance as that between the longitudinally extending wires 28 and 30. The heel portions 22 may also be provided with inwardly extending flange portions 25 which extend from the front to the rear of the heel portion 22 which support transversely extending wires 36 of wire shelf 16. The heel 22 is also provided with a cavity 32 having an open top to receive a downwardly extending leg 34 of the vertical support member 18. The length and width of the cavity 32 is substantially the same as the horizontal sides of the downwardly extending leg 34.

The downwardly extending leg 34 may also be provided with an upwardly extending finger portion 14 adjacent its downward terminating end which upon being received within the cavity 32 locks the leg 34 of the support member 18 within the heel portion 22. The heel portion 22 may also be provided with vertically extending grooves 38 on the front thereof to receive spaced transversely extending wires 36 which extend horizontally from back to front of the shelf, then vertically downward along the front of the wire shelf 16.

Figure 5:
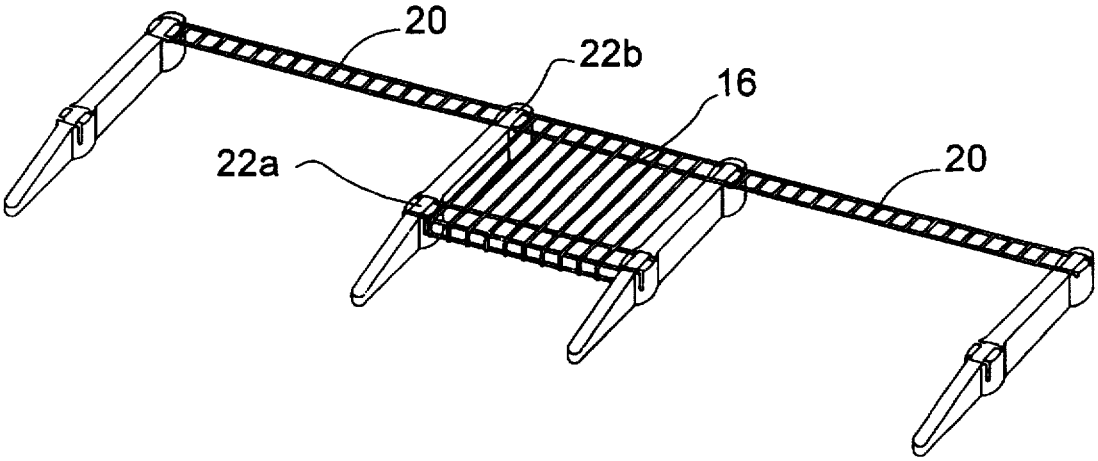
FIG. 5 is a perspective view of a portion of the storage system of FIG. 1 showing a plurality of support feet in spaced connecting arrangement.
Figure 6:
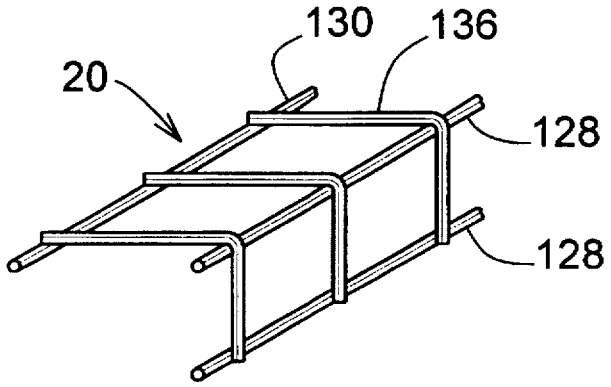
FIG. 6 is an enlarged perspective view of a portion of one component of the present invention.

As best shown in FIG. 5, support feet 12 are provided with two heel portions 22, the heel portion 22*a* is a front heel portion to receive the front portion of a wire shelf 16 and the front leg 34 of a vertical support member 18. The rear heel portion 22*b* receives the back of the wire shelf 16 as well as a back leg 34 of the support member 18. The back heel portion 22*b* may also receive a return wire strip 20 which is of generally L-shaped cross-section of substantially the same configuration as the front portion of the wire shelf 16. As shown in FIG. 6, the return wire strip 20 includes a pair of back longitudinally extending wires 128 and a longitudinally extending wire 130 which are disposed to fit within the slots 34 and 36, respectively. Transversely extending support wires 136 are also provided with the return wire strip 20.

In assembling a free standing adjustable storage system 10 of the present invention, a pair of support feet 12 are placed a preselected distance apart upon a flat surface, such as a closet floor or the like, in which the storage system is to be placed. A wire shelf 16 is placed upon the support feet 12 with the longitudinally extending and transversely extending wires 28, 30 and 36 of the wire shelf being placed within the grooves of the heel portions 22 (22*a*, 22*b*) of the support feet 12. Once the wire shelf 16 is mounted onto the feet 12, vertically extending support members 18 are then mounted onto the feet 12 with the downwardly extending leg portions 34 being received within the cavities 32 of the heel portions 22 with the wire shelf 16 being sandwiched therebetween. In other instances, wire return strips 20 are placed into the heel portions 22*b* of the feet 12 and the downwardly extending leg portions 34 of vertically extending support members 18 are received within the cavity 32 of the heel portion 22*b* with the return wire strip 20 being sandwiched therebetween.

Even though only one embodiment of the present invention has been shown and described in detail, it will be realized that various changes may be made to this specific embodiment shown and described without departing from the scope and spirit of the present invention in accordance with the claims appended hereto.

What is claimed is:

1. A free standing adjustable storage system comprising:

a pair of support feet in spaced parallel alignment, each foot having a top with means to receive a horizontally extending wire shelf and a leg of a vertical support member, each of said support feet having a first heel portion and a second heel portion, each of said heel portions having a first vertically extending slot and a second vertically extending slot, said first slot having a depth greater than said second slot, said first slot receiving front longitudinally extending vertically spaced horizontal edge wires of a wire shelf and said second slot receiving a longitudinally extending horizontal support wire spaced horizontally from said front longitudinally extending edge wires of said shelf; and, at least one wire shelf mounted onto said pair of support feet, said wire shelf being sandwiched between said support feet and said leg of a vertical support member.

2. The storage system of claim 1 including at least a pair of vertical support members, each of said vertical members being mounted onto each of said support feet with said wire shelf being sandwiched therebetween.

3. The storage system of claim 1, each heel portion of said support feet having a cavity with an open top therein, said cavity receiving a downwardly extending leg of said vertically extending support member.

4. A free standing adjustable storage system comprising:

a pair of support feet in spaced parallel alignment, each foot having a top with means to receive a horizontally extending wire shelf and a leg of a vertical support member;

at least one wire shelf mounted onto said pair of support feet, said wire shelf being sandwiched between said support feet and said leg of a vertical support member; and, at least one additional support foot and a wire return mounted onto said additional support foot and onto one of said pair of support feet.

5. A free standing adjustable storage system comprising:

a pair of support feet in spaced parallel alignment, each foot having a top with means to receive a horizontally extending wire shelf and a leg of a vertical support member, said vertical support member having a front vertically extending support portion and a back vertically extending support portion, each of said support portions having a downwardly extending leg portion at its lower extremity and a wire shelf receiving means at its upper extremity, said wire-shelf receiving means including a first vertically extending slot and a second vertically extending slot spaced a pre-selected horizontal distance from said first slot, said first vertically extending slot having a depth greater than said second vertically extending slot, said first slot disposed to receive a pair of vertically spaced longitudinally extending horizontal edge wires of a shelf, said second slot disposed to receive a longitudinally extending horizontal support wire of said wire shelf; and, at least one wire shelf mounted onto said pair of support feet, said wire shelf being sandwiched between said support feet and said leg of a vertical support member.

6. A support foot for a storage system comprising first and second heel portion, each of said heel portions having a first vertically extending slot and a second vertically extending slot spaced a preselected horizontal distance from said first slot, said first vertically extending slot having a depth greater than said second vertically extending slot, said first slot disposed to receive a pair of vertically spaced longitudinally extending horizontal edge wires of a wire shelf, said second slot disposed to receive a longitudinally extending horizontal support wire of said wire shelf.

7. The support foot of claim 6, each of said first and said second heel portions having cavities therein with an open top disposed to receive a leg of a vertical support member.

* * * * *